US005811931A

United States Patent [19]

Mueller-Mach et al.

[11] Patent Number: 5,811,931

[45] **Date of Patent: *Sep. 22, 1998**

[54] CAPPED EDGE EMITTER

[75] Inventors: Regina B. Mueller-Mach; Gerd O. Mueller, both of San Jose, Calif.

[73] Assignee: Hewlett Packard Company, Palo Alto, Calif.

[ * ] Notice: The term of this patent shall not extend beyond the expiration date of Pat. No. 5,525,866.

[21] Appl. No.: 610,174

[22] Filed: Mar. 4, 1996

[51] Int. Cl.[6] ..... H01J 1/62; H01J 63/04; G09G 3/10

[52] U.S. Cl. ..... 313/512; 313/505; 313/506; 313/498; 315/169.3; 315/169.1

[58] Field of Search ..... 313/512, 500, 313/501, 502, 505, 506, 507, 509, 110–113; 315/169.1, 169.3; 427/917

[56] References Cited

U.S. PATENT DOCUMENTS 5,525,866 6/1996 Mueller et al. ..... 313/505 X

FOREIGN PATENT DOCUMENTS

0515174A1 5/1992 European Pat. Off. ..... H05B 33/04

0710050 10/1995 European Pat. Off. ..... H05B 33/12

0721293A 12/1995 European Pat. Off. ..... H05B 33/12

*Primary Examiner*—Sandra L. O'Shea
*Assistant Examiner*—Mack Haynes
*Attorney, Agent, or Firm*—Timothy Rex Croll

[57] ABSTRACT

An edge emitter with a cap on top of a thin-film stack. The thin film stack includes a top transparent electrode, a bottom electrode, an active film between the two electrodes and an insulating film between the active film and the bottom electrode. Both the refractive indexes of the cap and the top transparent electrode are substantially matched to that of the active film to increase the amount of electroluminescent radiation propagating from the active film into the cap. The cap is thicker than the active film, and is made of a material with an attenuation to the electroluminescent radiation that is lower than that of the active film material. One side surface, the emitting side surface, of the cap is more transmissive to the electroluminescent radiation than the other side surfaces and the top surface of the cap. A significant portion of the electroluminescent radiation from the active film entering the cap is re-directed towards the emitting side surface to be radiated from the edge emitter. The emitting side surface can be tilted and the thickness of the insulating layer can be controlled to be within a predetermined range to increase the efficiency of the edge emitter.

20 Claims, 9 Drawing Sheets

CAPPED EDGE EMITTER

BACKGROUND OF THE INVENTION

The present invention relates generally to light generated by electroluminescence, and particularly to edge emitters emitting light generated by electroluminescence.

Typically, an edge emitter emitting light through electroluminescence has a structure with multiple films, known as a thin film electroluminescent stack. The stack typically includes five films, a conductive electrode, an insulating film, an active film, another insulating film and another electrode. The basic idea is to excite dopant ions in the active film. When the excited dopants relax, light is generated. The potential difference between the top and the bottom electrodes creates electric fields for excitation.

The insulating films and the active film are typically built as a sheet, with the top and the bottom electrodes as stripes E1 and E2. FIG. 1 shows a representation of the top view of this structure. The intersection of the two stripes defines a pixel. In the present example, the pixel has a length of l and a width of w. The width w is much smaller than the length l. The film stack is fabricated so that one of the width side is exposed to form the edge of the edge emitter. The idea is to have a large area generating light, and a small edge to define the size of a small beam of emitted light.

With an appropriate potential difference applied, light is generated in the active film between the two electrodes. After generation, most of the light propagates laterally in the film stack across the entire sheet by total internal reflections. Preferably, all the light generated should be directed to the narrow edge. However, due to the geometry of the film stack, only a small percentage of the light comes out from the edge.

As an example, if the edge emitter is used for the print head of a 600 dots-per-inch (dpi) printer, there should be more than 5000 pixels on a line, one adjacent to the other. Each pixel is responsible for one dot of the printer. In such an embodiment, the width of each dot is about 0.035 mm. Based on a pixel length of 3 mm and common edge emitter materials, a light power of 20,000 nW can be generated under each pixel. Although the power generated is high, probably, only about 70 nW will be coupled out through the edge. This gives a 0.35% optical efficiency.

One approach to increase the optical output is to increase the area of the pixel to generate more light. To keep the light beam from the edge small, the width has to be small. Therefore, the way to increase the area is to increase the length of the pixel. However, the film stack has attenuation. Measured attenuation lengths of a typical film stack lie in the range of 0.07 to 0.5 mm. Further increasing the length of a pixel will not increase the power emitted.

From the foregoing, it should be obvious that there is a need to increase the optical efficiency of an edge emitter. A higher percentage of the light generated in each pixel should be directed to go out from the edge, instead of propagating along the sheet in undesirable directions.

SUMMARY OF THE INVENTION

The present invention provides an edge emitter with significantly higher optical efficiency. Based on the present invention, a significantly higher percentage of light generated by each pixel is directed towards its corresponding edge.

The present invention incorporates a cap on top of a thin film electroluminescent stack. The cap gathers, re-directs and guides a significant portion of the generated radiation into the direction of the edge of the edge emitter. The thin film electroluminescent stack includes a top transparent electrode, a bottom electrode, an active film between the two electrodes, and an insulating layer between the active film and the bottom electrode. Note that as compared to conventional thin film stack, the thin film stack of the present invention does not have an insulating film between the active film and the top transparent electrode.

The cap, preferably thicker than the thin film stack, is made of a material with a lower attenuation than the film stack. Both the refractive indexes of the cap and the top transparent electrode are substantially matched to the refractive index of the active film to increase the amount of electroluminescent radiation propagating from the active film into the cap.

The present invention successfully identifies appropriate transparent electrodes; this is a challenging task all by itself. The cap has a number of side surfaces and a top surface, with the transmission coefficient of one side surface, known as the emitting side surface, being higher than the transmission coefficient of at least one other surface, known as the reflecting surface. In a preferred embodiment, the top surface and all the side surfaces of the cap, except the emitting side surface, are smooth and reflecting surfaces.

In operation, instead of propagating laterally along the film stack, significant amount of the light generated in the active region propagates into the cap, especially because the refractive indexes of the cap and the top transparent electrode are substantially matched to the refractive index of the active film. Most of the generated radiation in the cap, reflected by the reflecting surfaces, is guided to emit out of the cap from the emitting side surface. With the thickness of the cap more than the thickness of the film stack, light generated goes through fewer total internal reflections before emitted through the edge and the emitting side surface. This translates to reduced light attenuation. If the cap has a lower attenuation than the film stack, light attenuation will be further reduced.

In another preferred embodiment, the emitting side surface is tilted to increase the amount of generated radiation to be emitted from the emitting side surface. In yet another preferred embodiment, the edge emitter can be further improved by controlling the thickness of the insulating film to be within a predetermined range.

Other aspects and advantages of the present invention will become apparent from the following detailed description, which, when taken in conjunction with the accompanying drawings, illustrates by way of example the principles of the invention.

Same numerals in FIGS. 1–13 are assigned to similar elements in all the figures. Embodiments of the invention are discussed below with reference to FIGS. 1–13. However, those skilled in the art will readily appreciate that the detailed description given herein with respect to these figures is for explanatory purposes as the invention extends beyond these limited embodiments.

DETAILED DESCRIPTION OF THE INVENTION

Figure 1:
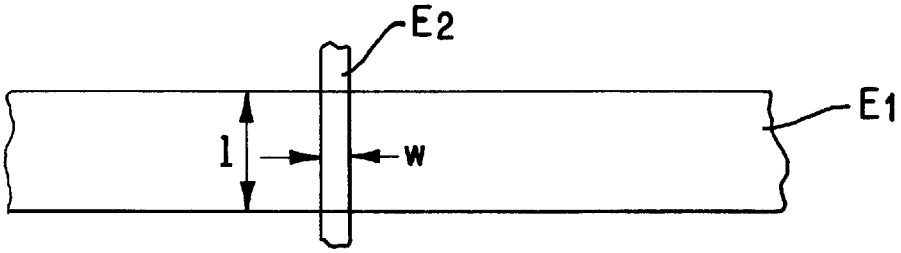
FIG. 1 (PRIOR ART)
FIG. 1 shows the top view of a prior art edge emitter.
Figure 2:
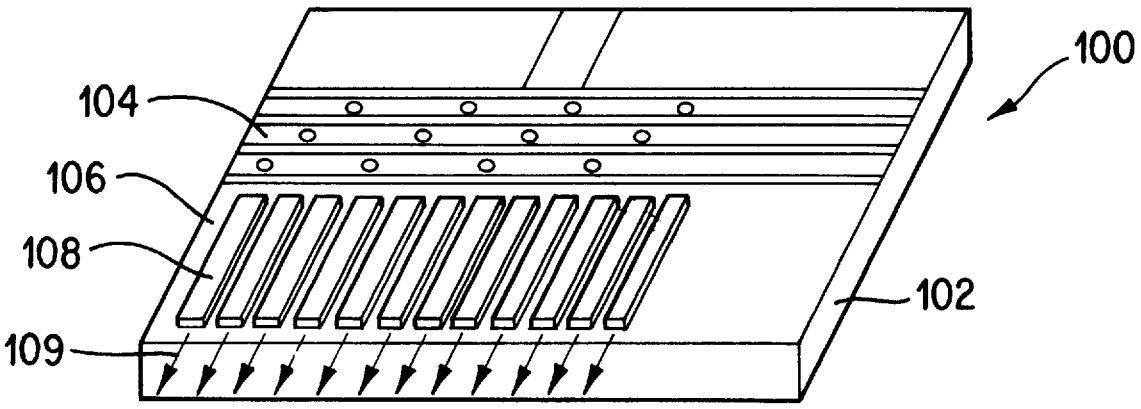
FIG. 2 shows a system with an array of preferred edge emitters of the present invention.

FIG. 2 shows a system 100 with an array 106 of preferred edge emitters, such as 108, of the present invention. The array 106 is typically on a substrate 102, such as glass. The system also shows multiplexing bus bars 104 connecting drivers to the edge emitters. The driver with multiplexers 104 will not be further described because they should be obvious to those skilled in the art. With the appropriate drive, each edge emitter would emit an electromagnetic radiation, such as the emitter 108 emitting the radiation 109.

Figure 3A:
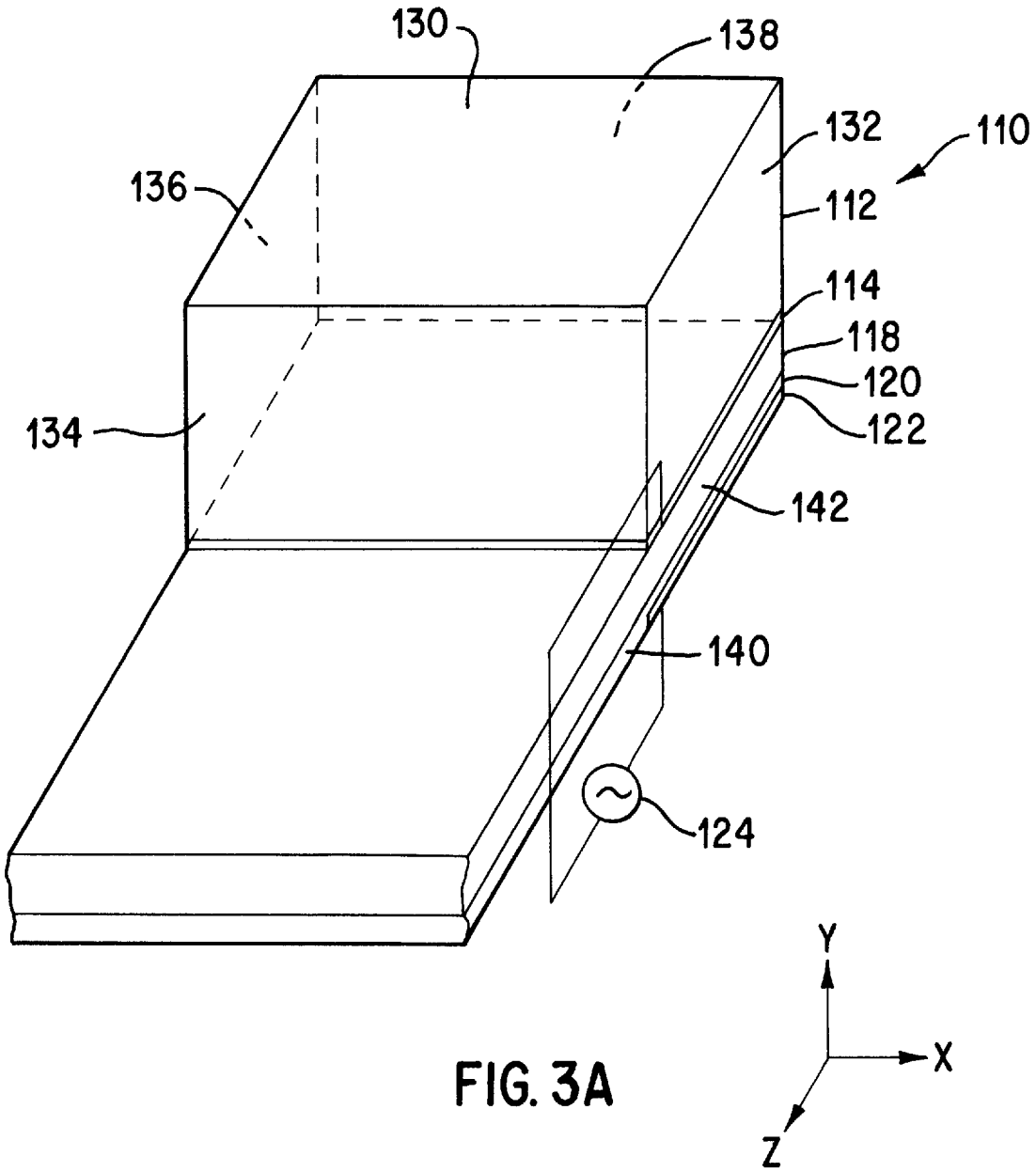
FIGS. 3A–C show cross-sections of preferred edge emitters of the present invention.

FIG. 3A shows a cross-section of a first preferred embodiment of an edge emitter 110. For clarity, the substrate 102 is not shown. The emitter is made of a cap 112 situated on top of a thin film electroluminescent stack to form a modified edge emitter—hereinafter known as an edge emitter. The thin film electroluminescent stack includes a transparent electrode 114; an active film 118; an insulating film 120; and a reflective electrode 122. The electrodes are conductive. Unlike conventional stacks, the stack in the present invention does not have an insulating film between the active film and the transparent electrode.

Electric fields are applied across the active film 118, such as by connecting a voltage source 124 on the two electrodes. The electric field across the active film excites dopant ions in the active film 118; and then the excited dopants relax to generate radiation. The fabrication processes of the preferred embodiments will not be described because such processes should be obvious to those skilled in the art.

The preferred embodiment 110 shows the transparent and the reflective electrodes well registered, with one directly on top of the other. In another preferred embodiment, one electrode can be much wider than another. It is only in the regions of overlap that there will be excitation and recombination.

Structurally, the reflective electrode 122, the insulating film 120 and the transparent electrode 114 are quite thin; the active film 118 is thicker, but the cap 112 is even thicker than the active film. In the preferred embodiment shown, the insulating film 120 on top of the reflective electrode fills in the gap between adjacent reflective electrodes, such as in the region 140. In another preferred embodiment, the reflective electrode 122 is much wider than the transparent electrode 114.

Materials for the cap should be selected according to their electromagnetic properties. This includes their refractive indexes, which should be similar to the index of the active film so as to enhance coupling of the radiation generated in the active film 118 into the cap 112. The cap should be made of a material with less attenuation per unit length of the generated radiation than the active film 118. Other factors to consider are the manufacturability of the cap on the transparent electrode in the desired dimensions. This includes the achievable smoothness of the surfaces, which is important, as will be explained.

The cap 112 has four side surfaces 132, 134, 136, 138, and a top surface 130. Preferably, radiation is directed to go out from one of the side surfaces (the emitting side surface 132) and from the edge 142 of the active film 118. For the present embodiment, the radiation preferably emits along the x-direction.

To enhance the directivity of the radiation, the emitting side surface 132 is made to have a higher transmission than the other side surfaces (the reflecting side surfaces 134, 136 and 138) and the top surface 130.

Figure 3B:
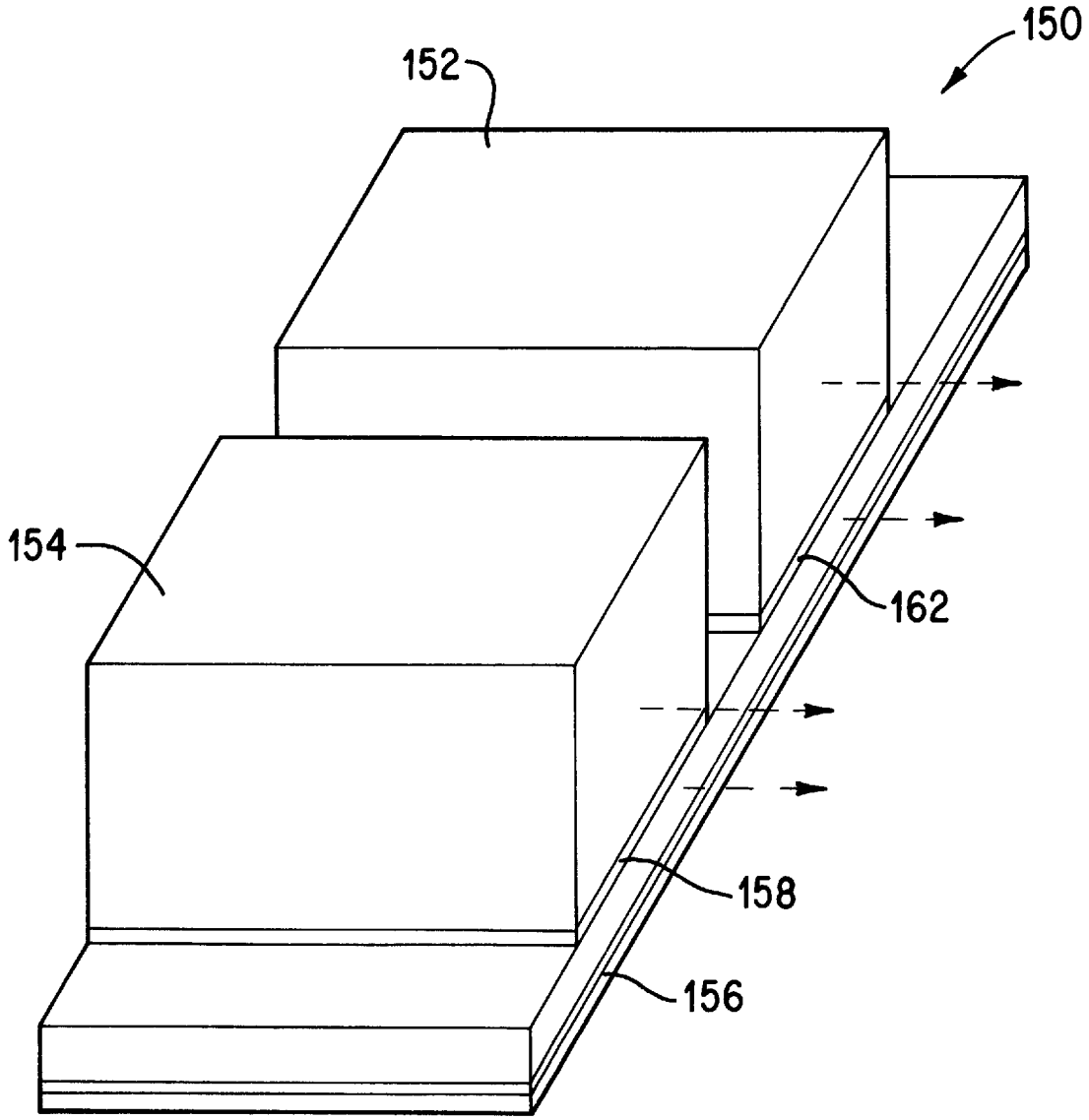

FIG. 3B shows another preferred embodiment 150 of the present invention. It shows two capped structures, 152 and 154. The reflective electrode 156 is common for both structures. However, each cap structure has its own transparent electrode, such as the cap 154 has the transparent electrode 158, and the cap 152 has the electrode 162.

Numerous methods may be used to achieve difference in transmission among the surfaces. A number of methods described below serve to be illustrative; other methods may also be used. A first method is to have a smooth top surface and reflecting side surfaces; optically, this means that those surfaces have high finesse. On the other hand, the emitting side surface is roughened, such as by sandblasting it. Roughening a surface to increase its transmission or radiation emission, and polishing a surface to decrease its transmission are taught in prior art references, such as "*ZnSiMn in Polycrystalline Electroluminescence Thin Film Display,*" published by Mach and Mueller in the J. Cryst. Growth 86, pages 866–872 in 1988, and "*The Counterplay between Brightness and Contrast in Electroluminescence Devices,*" published by Mach et al. in J. Luminescence 40/41, pages 779–781 in 1988.

Figure 3C:
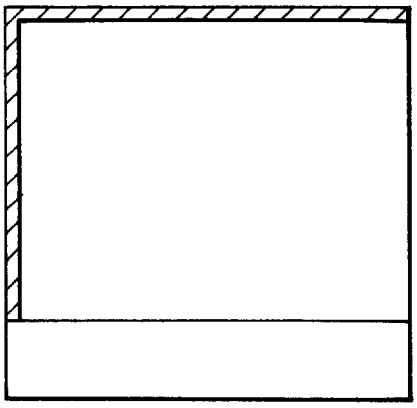

A second method is to cover the top surface and the reflecting side surfaces with metal films, for example, as shown in FIG. 3C. One should be careful with the metallization process so that the metal films will not accidentally form a conductive path between the two electrodes. A third method is to coat a film of material with a refractive index much lower than that of the cap on the cap's reflecting side surfaces and top surface. The mismatch in refractive indexes reflect incident radiation on those surfaces. A fourth method combines the second and the third method by first forming the low refractive index material on those surfaces and then covering them with metal films. Sometimes, it might be preferable to ignore the edge 142 of the active film 118, and focus on the emitting side surface 132, especially when the cap is much thicker than the active film. Note, also, that the emitting side surface 132 of the cap may not have to coincide with the edge 142 of the stack; it may extend beyond the edge. This may improve the ease in manufacturability of the edge emitter.

Figure 4:
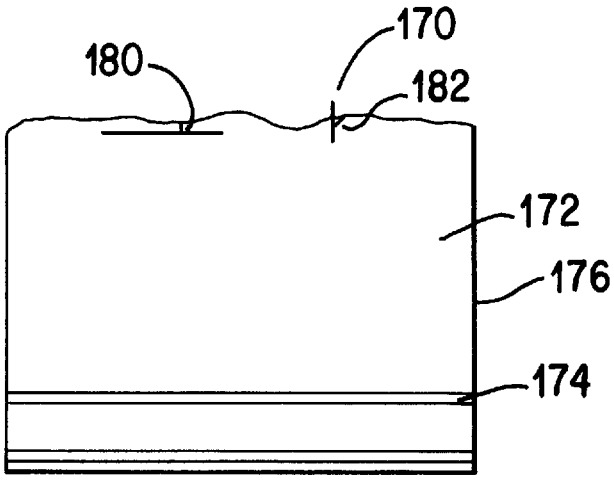
FIG. 4 shows another preferred embodiment increasing the re-directions of light by the top surface.

FIG. 4 shows another preferred embodiment of the present invention showing a fifth method to increase the re-direction of light by the top surface. The top surface 170 of a cap 172 is grooved to redirect light penetrating through the transparent electrode 174 of a thin film electroluminescent stack under small angles towards the emitting side surface 176. If the top surface is just smoothed, without other enhancement on its reflectivity, most of the incident radiation, except those within a cone, will still be reflected. The angle of the cone is the critical angle of the cap material. A cap material with refractive index of 2.3 would reflect about 90% of the incident light. The grooved structure further redirects a significant portion of the radiation within the cone towards the emitting side surface. Thus, radiation penetrating through the transparent electrode under small angles is also re-directed towards the emitting side surface. As an example, the ascending angle 180 of a groove is about 10 degrees, and the descending angle of the groove is about 45 degrees. The methods to generate such grooves should be well known to those skilled in the art.

The implementation of the above methods should be obvious to those skilled in the art, and will not be further described in this specification.

Figure 5:
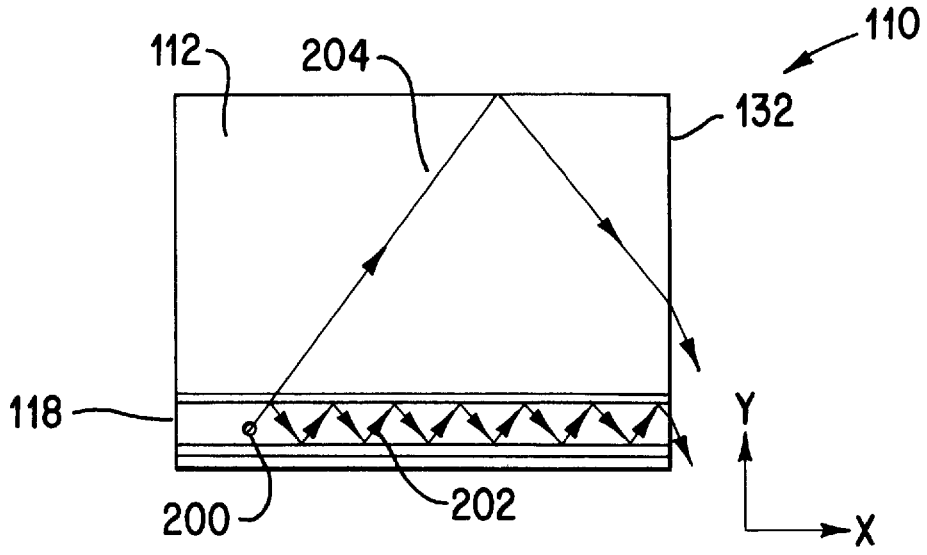
FIG. 5 shows a ray diagram comparing the paths of the generated radiation between the prior art and one cross section of the preferred embodiment of the present invention.

FIG. 5 shows a ray diagram comparing the paths of the generated radiation between the prior art and one perspective of the preferred embodiment 110 of the present invention. The perspective is a cross-section parallel to the reflecting side surface 134.

In a typical prior art edge emitter, radiation generated at 200 is directed across the active film 118 before it is radiated out of the edge emitter 110. The guiding is done through numerous total internal reflections, as shown by the path 202.

In the present invention, most of the radiation generated at 200 propagates to the cap 112. The cap is thicker than the active film 118. This leads to fewer total internal reflections before the radiation hits the emitting side surface 132. In the present example, radiation generated 200 follows the path 204 with one total internal reflection before it goes out of the emitting side surface 132. The attenuation of the radiation per unit length in the cap 112 is less than that in the active film 118. Thus, in the present invention, a higher percentage of the light generated radiates out of the emitter 110. In general, a thicker cap improves the guiding of the radiation towards the emitting side surface by reducing the number of total internal reflection. However, for certain application, the cap should not be too thick. This is because a thick cap increases the size of the beam of radiation coming out of the emitter.

Figure 6:
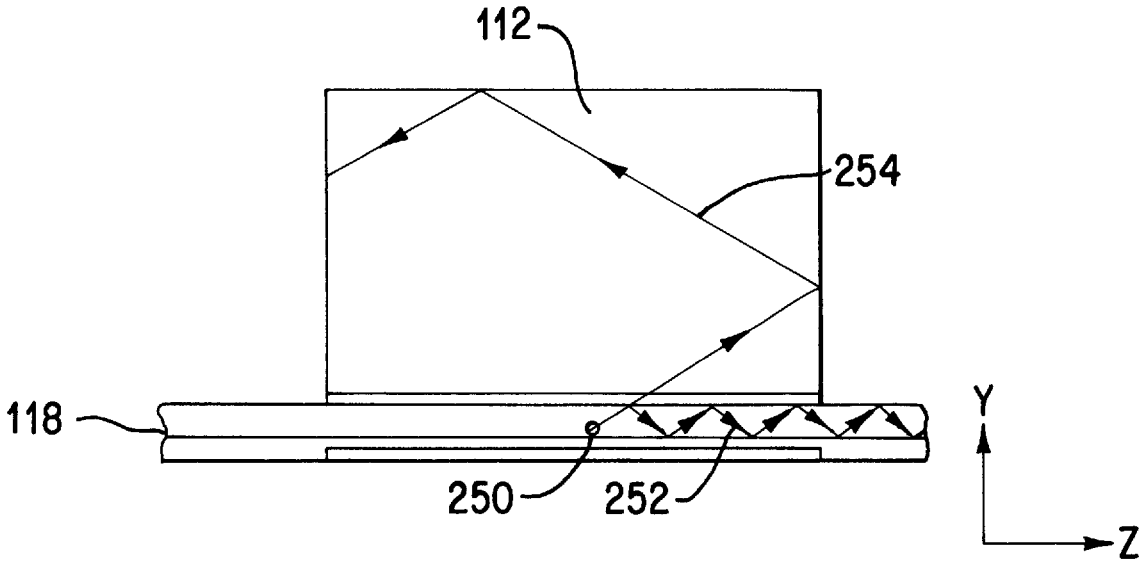
FIG. 6 shows a ray diagram comparing the paths of the generated radiation between the prior art and another cross section of the preferred embodiment of the present invention.

FIG. 6 shows a ray diagram comparing the paths of the generated radiation between the prior art and another perspective of the preferred embodiment 110 of the present invention. This perspective is the cross-section parallel to the emitting side surface 132. In the prior art, radiation generated at 250 is guided along the plane of the active film through the path 252 by numerous total internal reflections. Such radiation just propagates along the thin film electroluminescent stack; it is typically significantly attenuated and will not radiate from the edge 142 of the active film 118.

In the present invention, the radiation generated substantially follows the path 254 in the cap. The emitting side surface is preferably more transmissive than all the side surfaces and the top surface. As long as the radiation path 254 is not absolutely parallel to the emitting side surface 12, ultimately, if the radiation is not attenuated, the radiation would go out of the emitting side surface 132. This is achieved by internal reflections along "spiraling" paths.

In the present invention, the refractive indices of the cap 112 and the transparent electrode 114 is substantially matched to the refractive index of the active film 118 to reduce the effect of mismatch and to increase the amount of radiation propagating from the active film 118 into the cap 112.

Typically, a thin film electroluminescent stack has an additional insulating film between the transparent electrode and the active film. In the present invention, that insulating film is removed to reduce interface-reflections. Normally, the effect of mismatch at the active-film-and-the-removed-insulating-film interface and the effect of mismatch at the removed-insulating-film-and-the-transparent-electrode interface is not significant. This is because the removed insulating film and the transparent electrode are typically very thin with respect to the wavelength of the radiation emitted from the emitter.

Figure 7:
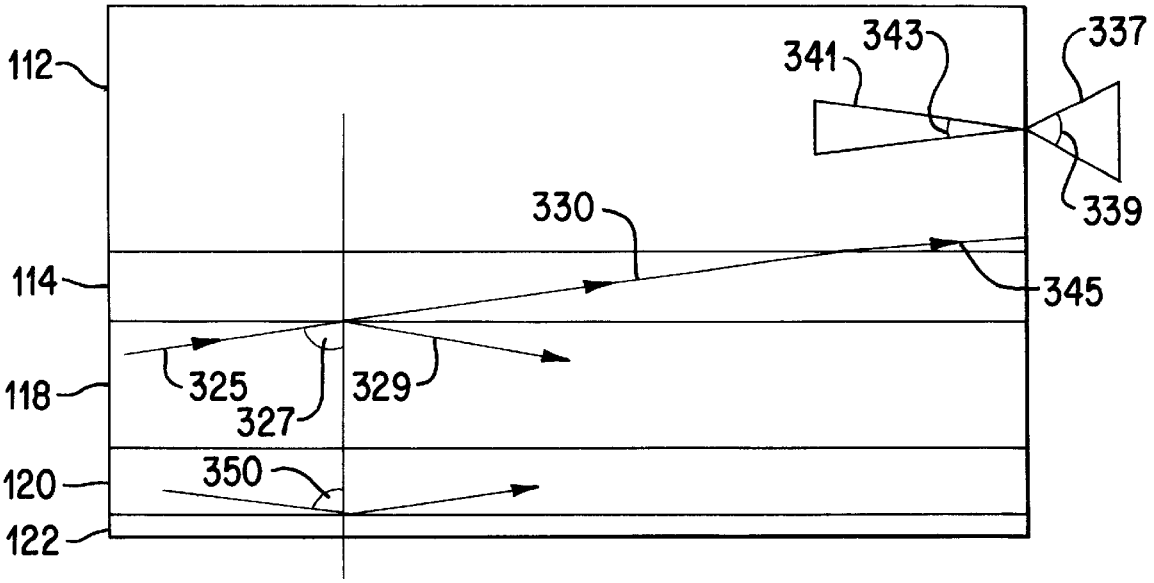
FIG. 7 shows the effect of mismatch between the active film and the electrodes in the present invention.

FIG. 7 shows the effect of mismatch between the active film and the electrodes, when the incident angle of the radiation at an interface is large. As explained below, the preferred incident angle may be quite large in the same embodiments of the present invention; and with a large incident angle, a mismatch in refractive indexes becomes significant. Thus, in the present invention, the typical insulating film between the transparent electrode and the active film is removed, and the refractive index of the transparent electrode is taken into consideration.

Figure 8:
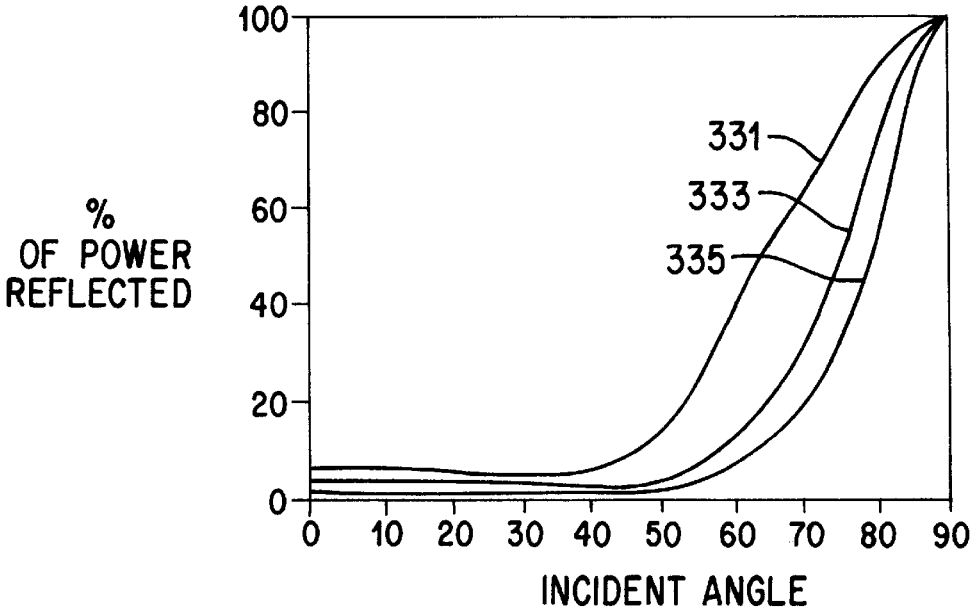
FIG. 8 shows the percentage of power reflected versus the incident angle for different types of the transparent electrodes in the present invention.

As discussed above, due to mismatch, a percentage of the incident radiation 325 generated in the active film 118 at an incident angle 327 is reflected back into the active film as reflected radiation 329. The higher the mismatch, the greater the amount of reflection. As examples, at a wavelength of 800 nm, with the refractive index of the active layer as 2.3, with the refractive index of the transparent electrode being an indium tin oxide layer (ITO) as 1.75 and another transparent electrode being a zinc oxide layer (ZnO) as 2.0, FIG. 8 shows the percentage of power reflected versus the incident angle 327. The curve 331 represents a transparent electrode using an ITO of 100 nm thick; the curve 333 represents a transparent electrode using a ZnO layer of 100 nm thick; and the curve 335 represents a transparent electrode using a ZnO layer of 80 nm thick. As the incident angle increases, the percentage of power reflected back into the active layer increases.

In numerous situations, the incident angle 327 should be as high as or even higher than 80 degrees. This is because typically, the emitting side surface is optically coupled to a lens to focus the emitted radiation. As an example, the lens has an F-number of 1, implying the radiation that can be coupled into the lens has to be confined within an acceptance cone 337 with an acceptance angle 339 of about +/−20 degrees. If the refractive index of the cap is 2.3, based on Snell's law, the cap cone 341 of radiation from the cap that falls within the acceptance cone 337 is limited to a cap angle 343 of about +/−8.5 degrees. Thus the lens will not accept any radiation 345 incident to the emitting side surface that has an incident angle on the emitting side surface larger than 8.5 degrees. Such a small angle implies that the incident angle 327 on the transparent electrode 114 interface should preferably be as high as or even higher than 80 degrees for the lens to capture the emitted radiation. As shown in FIG. 8, with an incident angle being more than 80 degrees, even using a 80 nm thick ZnO as the transparent layer (curve 335), which has a refractive index of 2.0, the transparent-layer-active-film interface reflects 60% of the incident power in every reflection. The above results include the effects of both the active-film-transparent-layer interface and the transparent-layer-cap interface.

Based on the above analysis, the present invention has removed the insulating film between the transparent electrode and the active film. Also, the refractive indices of the cap and the transparent electrode are substantially matched to the refractive index of the active film to reduce the amount of power reflected at the active-film-transparent-electrode interface, and at the transparent-electrode-cap interface. In one preferred embodiment, substantially matched is defined as having both the refractive indexes of the cap and the transparent electrode being within about +/−10% of the refractive index of the active film.

As described above, the desired incident angle 327 may be more than 80 degrees. At those incident angles, the percentage of power reflected is high. As shown in FIG. 8, one way to reduce the percentage of power reflected is to reduce the magnitude of the incident angle 327.

Figure 9:
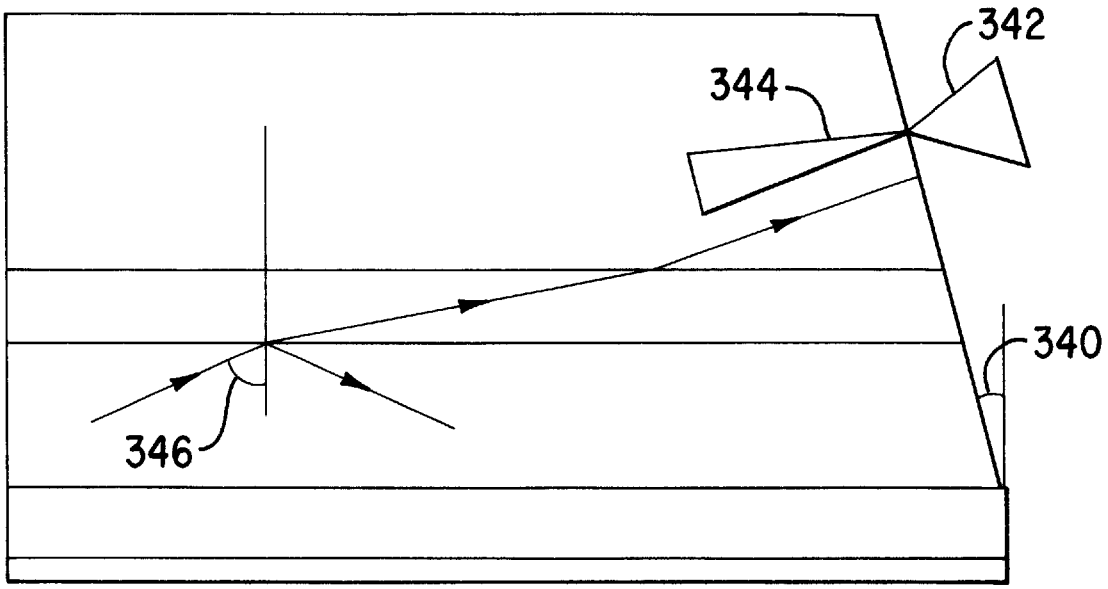
FIG. 9 shows tilting the emitting side surface in the present invention.

One way to reduce the magnitude of the desired incident angle 327 is to tilt the emitting side surface. FIG. 9 shows tilting the emitting side surface by an angle 340, such as 15 degrees. The acceptance cone 342 and the cap cone 344 remain the same as before the tilt, but in terms of orientation, they are also tilted by the same angle 340. In turn, the desired incident angles 346 or the incident angles of the generated radiation that fall into the acceptance cone 342 will be reduced by the tilt angle 340. A lower incident angle reduces the percentage of power reflected at the active-film-transparent-electrode interface when the index of the active film is not perfectly matched to the index of the transparent electrode. Thus, one can control the tilt of the emitting side surface to increase the amount of radiation emitted from the emitting side surface.

Figure 10:
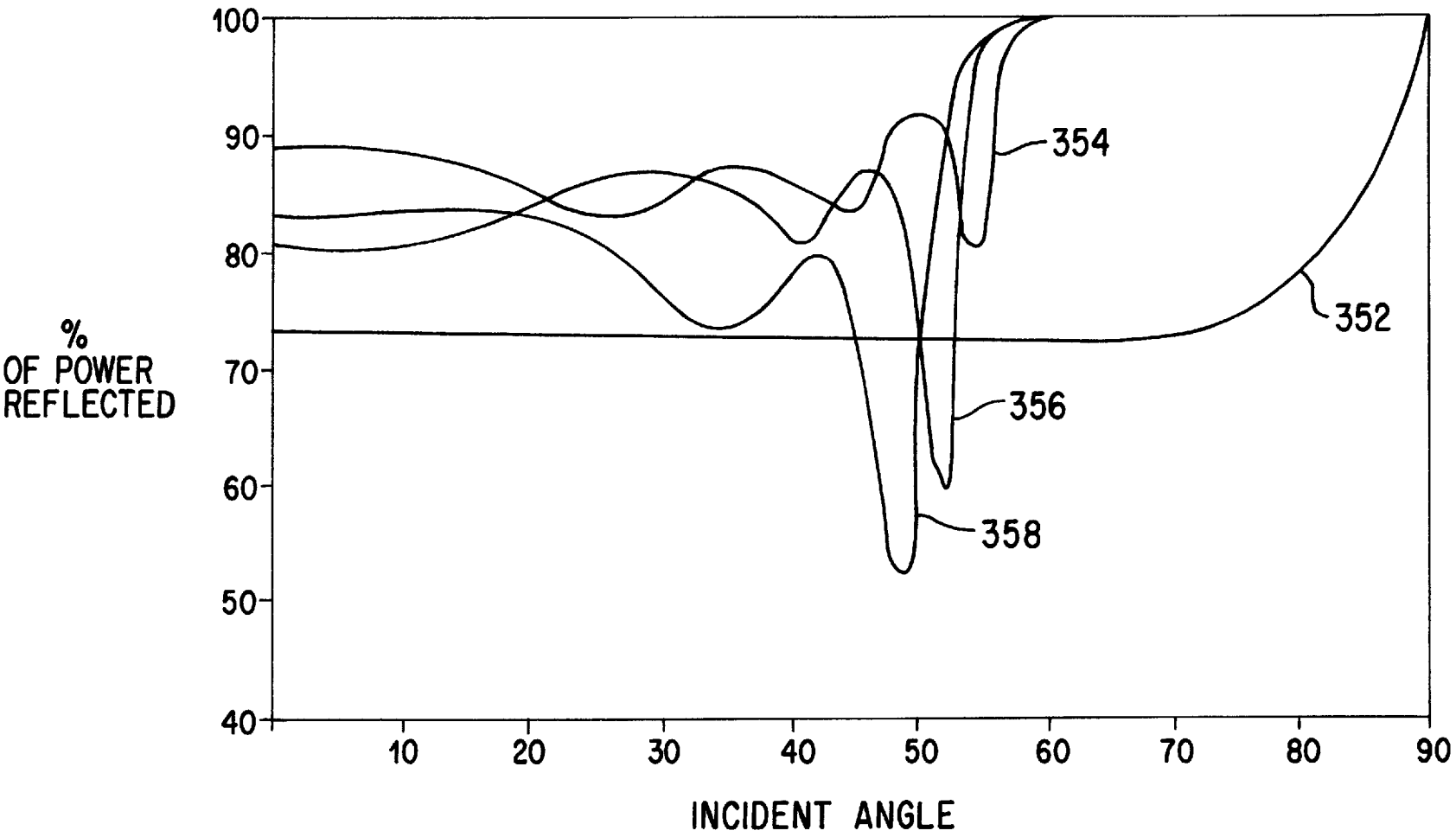
FIG. 10 shows the percentage of power reflected by the reflective electrode as a function of incident angle for different thicknesses of the insulating film in the present invention.

The present invention can be further improved by confining the thickness of the insulating film 120 to be within certain ranges. Again this is due to the acceptance cone discussed above. One prefers the reflective electrode 122 to be 100% reflective. However, although the insulating film should be very thin, if the insulating film is too thin, the results may not be as desirable. For example, FIG. 10 shows the percentage of power reflected by an aluminum reflective electrode of about 100 to 200 nanometers thick as a function of incident angle 350 on the reflective electrode 122 for different thicknesses of the insulating film. The curve 352 represents the reflected power for an emitted radiation at 800 nanometer with an extremely thin insulating film 120—the insulating film has practically zero thickness; the other curves represent the reflected power for an insulating film of silicon oxynitride that is about 360 nanometers thick with the emitted radiation at 550 nanometers (354), 650 nanometers (356) and 800 nanometers (358) respectively. For an insulating film that is extremely thin, curve 352 shows that for the reflective electrode to be 100% reflective, the incident angle 350 has to be close to 90 degrees. As explained above, due to the acceptance cone, the desired incident angle of concern can be quite large, but do not have to be almost 90 degrees. As shown by curves 354 to 358, with an insulating film thickness of about 360 nanometers, the amount of power reflected by the reflecting electrode is practically 100% for radiation equal to or more than 550 nanometers, even if the incident angle 350 on the reflective electrode is just more than 70 degrees. Thus, the thickness of the insulating film is controlled to increase the amount of radiation reflected from the reflective electrode back into the active film.

Working Example

The invention will be further clarified by a consideration of the following example, which is intended to be purely exemplary of using the invention.

The reflecting electrode 122 is made of aluminum. The insulating film is made of siliconoxinitride, with a refractive index of about 1.7. The active film is made of zinc sulphide doped with manganese. The refractive index of the active film is about 2.3. The transparent electrode is made of cadmium sulphide that has a refractive index also between 2.3 and 2.4. To make the cadmium sulphide conducting, it is doped by one of the following elements: chlorine, gallium and indium. The range of dopant is preferably between 0.02 and 0.6 atomic percent. The cap is made of a Chalcogenide glass that has a refractive index between 2.1 and 2.5. A number of ways may be used to fabricate the Chalcogenide glass; one example is shown in publication titled, *"Index of Refractive and D.C. Electrical Conducting in* $Ge_{40-x}Sb_xS_{60}$ *Glasses,"* published by Tichi et al., in the Czech J. Phys. B32, pages 1363–1373, in 1982, teaching how to build Chalcogenide glasses with refractive indices that are in the range of 2.3 to 2.6.

In anther preferred embodiment, the transparent electrode is a part of the cap; for example, both are made of Chalcogenide glass, with the transparent electrode portion of the glass being doped to make it conducting.

The reflecting electrode has a thickness (y-direction) of about 100 to 200 nanometers; the insulating film has the thickness of about 300 to 400 nanometers; the active film is about 1 micron thick; and the transparent electrode is about 200 nanometers thick.

The cap is about 10 microns thick (y-direction), 0.04 mm wide (z-direction) and 3 mm long (x-direction). The reflecting side surfaces and the top surface are covered by aluminum with a thickness of about 1000 Angstroms. The reflective performance can be further improved if there is a film with a refractive index lower than that of the cap, such as cryolite, between the cap and the metal surface. Cryolite has a refractive index of 1.33.

The electroluminescent radiation is yellow, with a wavelength of 600 nm. The optical efficiency of the above structure increases by about 1000% as compared to a similar structure with the additional insulating film between the transparent film and the active film, without the cap 112, without the matched refractive indexes and without the controlled insulating film thickness.

Conclusions with Other Embodiments

The reflective electrode does not have to be reflective. For such an embodiment, the edge emitter may not be as efficient because some of the radiation propagate through the "reflective electrode."

The present invention describes the emitting side surface having a higher transmission than the other side surfaces. In another embodiment, the emitting side surface has a higher transmission than at least one side surface, such as the surface 136, which is directly opposite to the emitting surface 132 in FIG. 3A. This is achieved, for example, by roughening the emitting side surface, or by making one side surface reflective. With such a structure, radiation generated have a certain preferred directivity; more radiation emits from the roughened surface than from the other surfaces, or more radiation propagates along directions away from the reflecting surface.

Another improvement to the preferred embodiment is to curve the emitting side surface of the cap into a lens structure to generate lens action. This will improve outcoupling and/or the angular distribution of the emitted radiation. Similar results may be achieved by Fresnel grooving the emitting side surface. Methods to achieve such curving or grooving are well-known to those skilled in the art and will not be further described.

Figure 11:
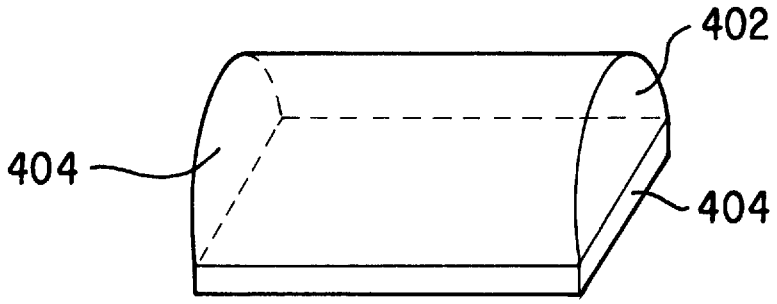
FIG. 11 shows a different preferred embodiment of the present invention.

The present invention describes the cap being a rectangular block. The cap may be made of other structures with more side surfaces or curved surfaces; an example is shown in FIG. 11, with the cap 402 having a curved top surface sitting on a thin film stack 404. In this embodiment, the side surface 404 has a higher transmission coefficient than other surfaces.

Figure 12:
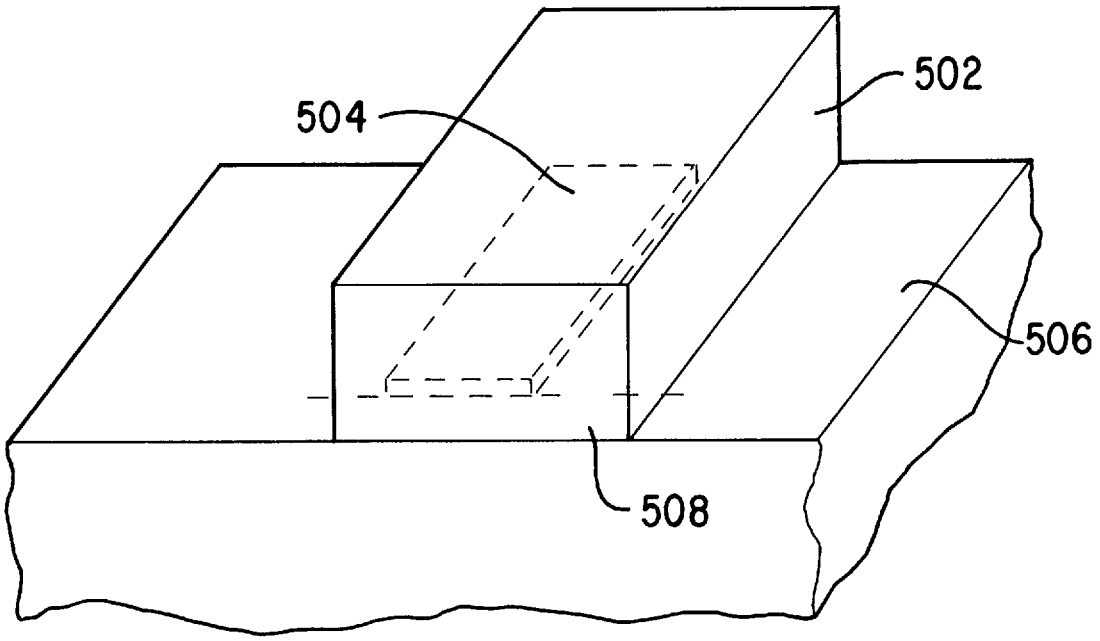
FIG. 12 shows another preferred embodiment of the present invention.
Figure 13:
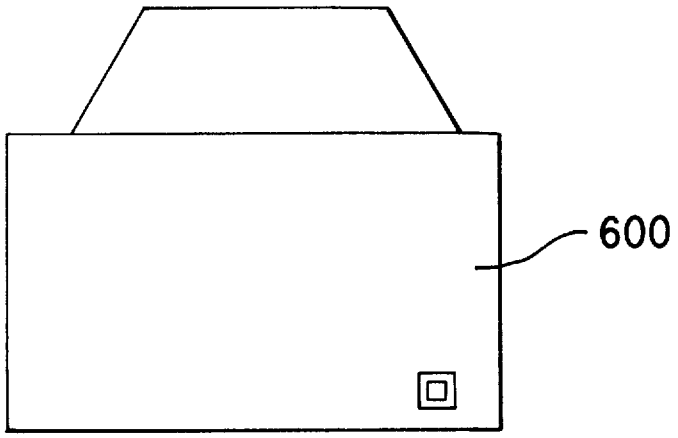

FIG. 12 shows another preferred embodiment of the present invention. In this embodiment, a cap 502 encapsulates an electroluminescent film stack 504; both the cap and the film stack sits on a substrate 506. In this embodiment, the bottom surface 508 of the cap is also a reflecting surface.

In one preferred embodiment, the emitting side surface is covered by an anti-reflective coating, which has a thickness of about one quarter of the wavelength of the emitting radiation in the coating. The refractive index of the anti-reflective coating is preferably about equal to or lower than the square root of the refractive index of the cap. Such a reflective coating would further enhance radiation emission from the cap. One example of such type of anti-reflective coating is silicon dioxide, which has a refractive index of 1.5. The preferred thickness of such a coating for an emitted radiation of 800 nm is about 133 nm.

In another preferred embodiment, the thin film electroluminescent stack is on top of a cap, which is on top of a substrate. For this embodiment, the stack includes a top reflective electrode, a bottom transparent electrode, an active film between the two electrodes, and an insulating layer between the active film and the top electrode. Again the cap gathers, re-directs and guides a significant portion of the generated radiation into the direction of the edge of the edge emitter.

The preferred embodiments can be used in a printer, (such as printer 600 of FIG. 13) with the edge emitter as pixel illuminators. It should be well known to those skilled in the art the methods to incorporate an edge emitter as pixel illuminators in a printer. In fact, Leksell et al. in U.S. Pat. No. 4,928,118, titled, "Enhanced Resolution Electrophotographic-Type Imaging Station," have taught methods to implement a different type of edge emitter in a printer. Thus, further disclosure is not included.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

We claim:

1. An edge emitter comprising:

a thin film electroluminescent stack including a top transparent electrode, a bottom electrode, an active film between the two electrodes, and an insulating film between the active film and the bottom electrode; and a cap on top of the transparent electrode, having a plurality of side surfaces and a top surface, with the transmission coefficient of one side surface, known as the emitting side surface, being higher than the transmission coefficient of at least one other surface, known as the reflecting surface so that a higher percentage of the electroluminescent radiation propagating from the active film to the cap radiate out of the edge emitter from the emitting side surface than from the reflecting surface;

wherein:

the active film, the cap and the top transparent electrode, each has its corresponding refractive index; and both the refractive indexes of the cap and the top transparent electrode are substantially matched to the refractive index of the active film to increase the amount of electroluminescent radiation propagating from the active film into the cap.

2. An edge emitter as recited in claim 1, wherein:

the transmission coefficient of the emitting side surface is higher than the transmission coefficient of the other side surfaces and the top surface; and the top surface with all the other side surfaces other than the emitting side surface are the reflecting surfaces.

3. An edge emitter as recited in claim 1 wherein the transparent electrode is made of cadmium sulphide.

4. An edge emitter as recited in claim 1 wherein the tilt of the emitting side surface can be controlled to increase the amount of radiation emitted from the emitting side surface.

5. An edge emitter as recited in claim 1 wherein the thickness of the insulating layer is controlled to increase the amount of radiation reflected from the bottom electrode back into the active film.

6. An edge emitter as recited in claim 5 wherein the thickness of the insulating film is substantially between 300 and 400 nanometer.

7. An edge emitter as recited in claim 1 wherein both the refractive indexes of the cap and the transparent electrode are substantially within +/−10% of the refractive index of the active film.

8. An edge emitter as recited in claim 1, wherein the cap is thicker than all of the other films and electrodes.

9. An edge emitter as recited in claim 1, wherein the attenuation per unit length of the electroluminescent radiation is lower in the cap than in the active film.

10. An edge emitter as recited in claim 2, wherein the wavelength of the electroluminescent radiation is larger than the thickness of any one element selected from the group of the electrode and the films, except the active film and the cap.

11. An edge emitter as recited in claim 1, wherein the top surface of the cap is grooved to further re-direct generated electroluminescent radiation back into the cap, and towards the emitting side surface.

12. An edge emitter as recited in claim 1, wherein the refractive index of the cap is larger than the refractive index of the active film.

13. An edge emitter as recited in claim 1, wherein the cap is a Chalcogenide glass.

14. An edge emitter as recited in claim 1, wherein the reflecting surfaces of the cap are metallized.

15. An edge emitter as recited in claim 1, wherein the reflecting surfaces of the cap are coated with a material with a refractive index lower than the refractive index of the cap.

16. An edge emitter as recited in claim 1, wherein the emitting side surface is covered by an anti-reflective coating, whose refractive index is substantially equal to or less than the square root of the refractive index of the cap, and whose thickness is about one-quarter of the wavelength of the radiation in the coating.

17. An edge emitter as recited in claim 1, wherein the emitting surface is roughened to increase radiation emission from that surface.

18. An edge emitter as recited in claim 1, wherein the emitting surface is curved to increase radiation emission, to generate lens action, and to guide the radiation emitted from that surface.

19. An edge emitter as recited in claim 1, wherein the emitting surface is Fresnel grooved to increase radiation emission, to generate lens action for the radiation emitted from that surface.

20. A printer having an edge emitter as recited in claim 1.

* * * * *